US006119416A

United States Patent [19]

Larson

[11] Patent Number: 6,119,416

[45] Date of Patent: Sep. 19, 2000

[54] FLASHING SYSTEM

[75] Inventor: John A. Larson, Parkland, Fla.

[73] Assignee: Plastic Components, Inc., Miami, Fla.

[21] Appl. No.: 09/240,238

[22] Filed: Jan. 30, 1999

[51] Int. Cl.[7] ..... E06B 1/04

[52] U.S. Cl. ..... 52/212; 52/210; 52/656.9; 52/717.01; 52/209; 52/287.1; 49/504

[58] Field of Search ..... 52/58–62, 210–213, 52/656.4, 656.9, 204.1, 204.53, 209, 287.1, 717.01, 302.1, 302.3; 49/501, 504

[56] References Cited

U.S. PATENT DOCUMENTS

| | | | |
|---|---|---|---|
| 4,207,707 | 6/1980 | Holdiman et al. | 49/501 |
| 4,982,530 | 1/1991 | Palmer | 52/211 X |
| 5,022,204 | 6/1991 | Anderson | 52/211 |
| 5,210,986 | 5/1993 | Hagemeyer et al. | 52/211 |
| 5,625,992 | 5/1997 | Strick et al. | 52/212 X |
| 5,722,207 | 3/1998 | Anderson et al. | 52/213 X |
| 5,921,056 | 7/1999 | Weiss et al. | 52/212 X |
| 5,966,880 | 10/1999 | Bridges et al. | 52/212 X |

*Primary Examiner*—Carl D. Friedman
*Assistant Examiner*—Winnie Yip

[57] ABSTRACT

There is described an improved flashing system for exterior doors and windows. The system comprises a header, right and left hand vertical drainage channels and right and left hand corner sections which join the header to the vertical channels on either side of the door or window. The header is designed to provide normal protection for the top of the door or window from water infiltration and also provides at the rear thereof a dam and weep holes for removal of any rainwater which may infiltrate between the flashing and applied siding. The system design provides a continuous channel to conduct any infiltrating water from the header via the corner sections to the vertical channels wherefrom it drains downward and is harmlessly removed at the base of the window or door.

5 Claims, 3 Drawing Sheets

FLASHING SYSTEM

FIELD OF THE INVENTION

The present invention relates to an improved exterior window or door flashing system which inhibits the intrusion of rainwater into and behind applied siding and provides a passage to trap and drain off any such water before it can infiltrate behind the siding and damage the underlying sheathing.

BACKGROUND OF THE INVENTION

It has become a common building practice to construct buildings, particularly commercial and apartment buildings, using expanded foam as the exterior surface or siding. Generally in such applications, the expanded foam is about one inch thick and is coated with a cementaceous coating to provide the appearance of stucco. While such a finishing technique provides an attractive appearance and generally durable exterior, it has been found that current methods for flashing about doors and windows are often inadequate to completely inhibit the entry of rainwater. When this water does infiltrate behind the flashing/siding, it becomes trapped therebehind and results in rotting or deterioration of the underlying plywood or other type of sheathing.

The existence of this condition requires that the expanded foam siding be cut back around windows and doors to a thickness of about one inch so that a new seal may be established about the periphery of the door or window. The most commonly used such technique requires installing silicone caulking at the corners of the opening, filling the cut out portion between the window or door and the expanded foam siding with a polyurethane foam "backer-rod" and then caulking over the "backer-rod" to seal the opening. While this technique provides a repair it is often not permanent and requires redoing. Additionally, when it becomes necessary to recaulk it is often difficult to remove the old caulking without damaging the "backer-rod" and having to redo the entire retrofit installation.

The improved flashing system of the present invention provides a means for inserting a permanent flashing between the door/window and the expanded foam siding. This improved flashing provides for removal by drainage of any water which may infiltrate the system between the flashing and the siding while providing a readily maintainable caulking bead which can be repaired in the normal course of routine maintenance without the risk of damaging the "backer-rod" or the need to cut out any portion thereof.

SUMMARY OF THE INVENTION

According to the present invention, there is provided a five piece flashing system comprising a header, right and left hand vertical drainage channels and right and left hand corner sections which join the header to the vertical channels on either side of the door/window. The header is designed to provide normal protection for the top of the door or window from water penetration and also provides at the rear thereof a dam and weep holes for removal of any water which may infiltrate between the flashing and the siding. The system design provides a channel to conduct any infiltrating water from the header via the corner sections to the vertical channels wherefrom it drains downward and is harmlessly removed at the base of the door or window.

DETAILED DESCRIPTION OF THE INVENTION

The flashing system of the present invention is intended primarily as a retrofit for installation into door and window openings where the original waterproofing system has failed, but could also be used for new construction to avoid water infiltration problems of the type encountered with previous new construction systems.

The flashing system of the present invention comprises a horizontal header section which fits over the top of the window or door, right and left hand corner sections which are fitted to either end of the header section by insertion of portions of the header section into slots or channels in the right and left hand corner sections, and left and right hand vertical drainage channels which are similarly fitted into slots or channels in the right and left hand corner sections. Assembly of the various sections, as described in greater detail hereinafter, provides a channel or path to drain rainwater which may infiltrate between the header and the overlying siding into the vertical drainage channels so that it can be harmlessly removed at the bottom of the door or window.

Figure 3:
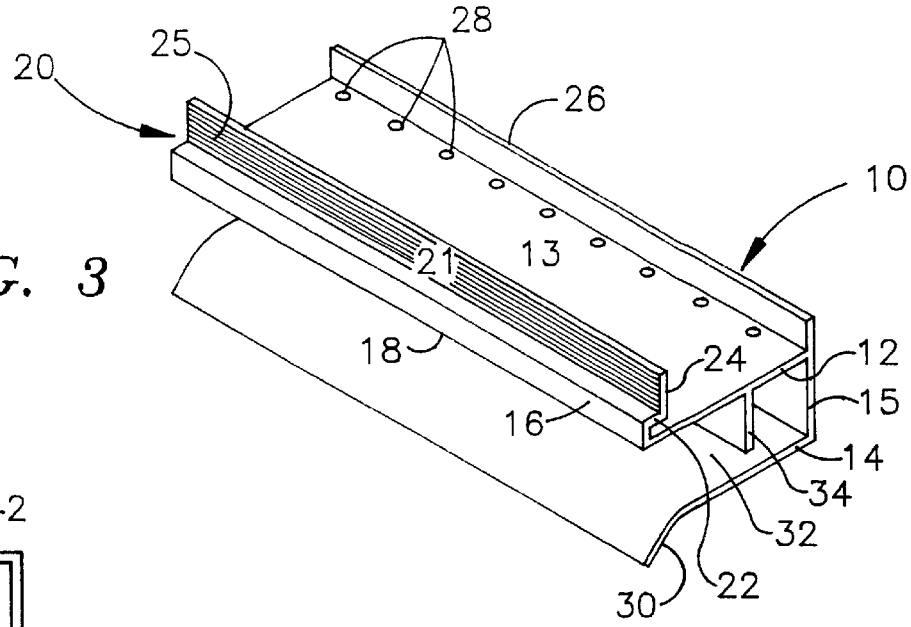
FIG. 3 is a perspective view of the header section of the flashing system of the present invention.
Figure 6:
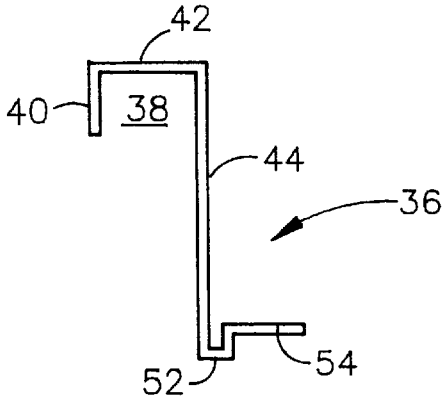
FIG. 6 is an end view of the right hand vertical channel section of the flashing system of the present invention.

As shown in FIG. 3, the header is a generally U-shaped section or channel having a series of flanges extending therefrom. Although the header and vertical channels are shown in the accompanying drawings as being generally rectangular, the skilled artisan will readily recognized that interior curved channels could be similarly effective when assembled and applied as described herein.

Header 10 has an upper leg 12 having an outer surface 13, a lower leg 14 and a base 15 which forms the innermost/rearmost portion of header 10. First flange 16 extends vertically and longitudinally along the front edge 18 of upper surface 13. Extending inwardly from first flange 16 along its length is L-shaped flange 20 whose lower leg 22 is generally parallel to outer surface 13, and whose upper leg 24 is generally parallel to first flange 16. According to a preferred embodiment of the present invention, front surface 21 of upper leg 24 has longitudinal ridges 25 to assist with the adhesion of subsequently applied caulking in the final installation operation.

Figure 4:
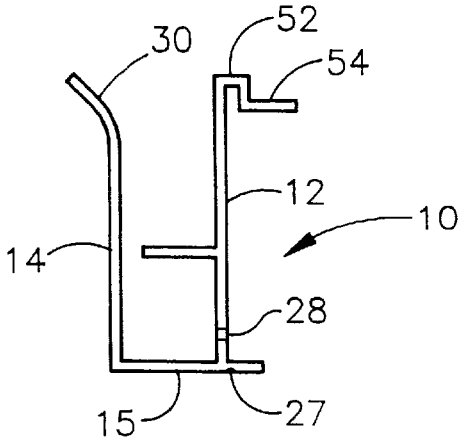
FIG. 4 is an end view of the header section of the flashing system of the present invention.

Extending longitudinally and generally vertically from the rearmost edge of upper surface 13 is dam 26 which is generally parallel to base 15 and in a sense may appear to be an extension of base 15 through and beyond the rearmost portion of upper leg 12. According to a preferred embodiment of the present invention, dam 26 is scored or indented as shown at 27 in FIG. 4. This indentation or scoring of dam 26 at or just above the junction between upper surface 13 and the base of dam 26 permits easy removal by tearing of the dam to any desired length for installation on a variety of different sized windows and doors as described more fully hereinafter. Just forward of dam 26 are weep holes 28 which allow the passage of any rainwater which infiltrates between the header and the siding as will be described in greater detail hereinafter.

The portion of lower leg 14 which extends forward of first flange 16 extends downward to form drip flange 30 which extends longitudinally along the full length of header 10. Preferably, drip flange 30 extends at about a 45 degree angle downward. Although it is preferred that drip flange 30 begin its downward bend beyond or forward of first flange 16, in some installations because of the design of the window or door, it may be possible that the downward angle initiate behind first flange 16.

Extending downward at an approximate right angle from leg 12 into the channel 32 defined by upper leg 12, lower leg 14 and base 15 extends second flange 34. Second flange 34 extends longitudinally generally parallel to base 15 at a depth greater than one half that of channel 30 but not all of the way to leg 14 so as to provide a stop for a subsequently installed length of backer-rod which is inserted into channel 32 in the final installation. The presence of flange 34 preserves the integrity of the water drainage channel at the rear of channel 30 upon installation of the backer-rod which prevents intrusion of water at the front of channel 32.

Figure 5:
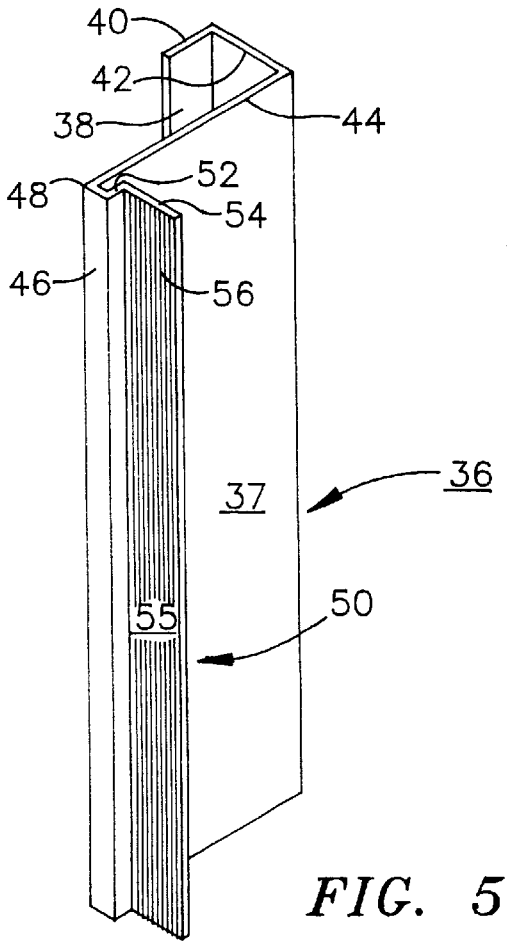
FIG. 5 is a perspective view of the right hand vertical channel section of the flashing system of the present invention.

Vertical channel 36 is depicted in perspective in FIG. 5. Vertical channel 36, like header 10, comprises a generally U-shaped channel 38 defined by short leg 40, base leg 42 and long leg 44. Third flange 46 extends outwardly and longitudinally at a generally right angle from the free end 48 of long leg 44. Extending inwardly and longitudinally toward base 15 is L-shaped flange 50 whose base leg 52 is generally parallel to long leg 44 and whose upper leg 54 is generally parallel to base leg 42. According to a preferred embodiment, the front surface 55 of leg 54 has a series of longitudinal ridges 56 which assist with the adhesion of subsequently applied caulking in the final installation process.

Figure 1:
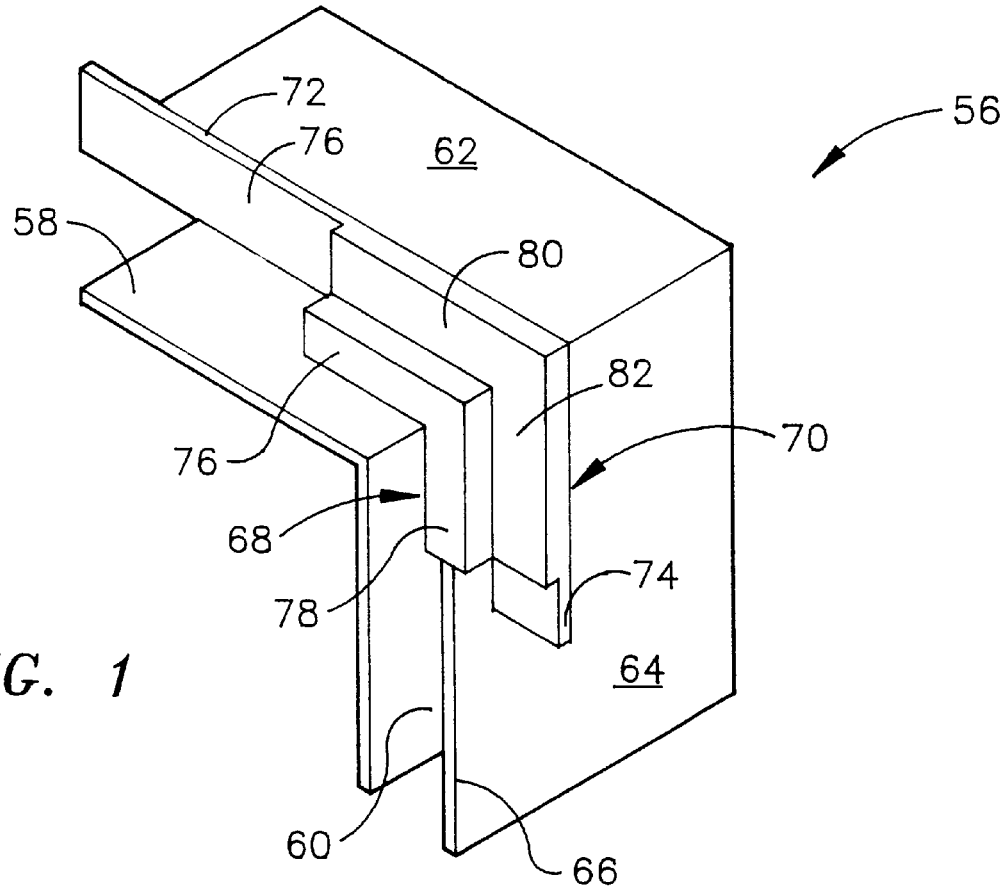
FIG. 1 is a perspective view of a right hand corner section of the flashing system of the present invention.
Figure 2:
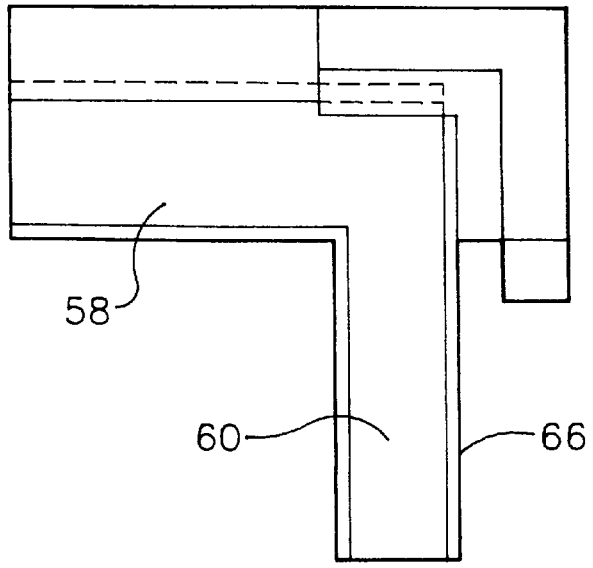
FIG. 2 is a front view of a right hand corner section of the flashing system of the present invention.

FIG. 1 depicts a right hand corner section of the flashing system of the present invention. Corner section 56 generally comprises a right angled channel having a horizontal leg 58 and a vertical leg 60, a horizontal outer surface 62 on horizontal leg 58, a vertical outer surface 64 on vertical leg 60, and an outer front edge 66 which extends the length of horizontal leg 58 and vertical leg 60. Extending upwardly from horizontal outer surface 62, vertical outer surface 64 and outer front edge 66 are a pair of L-shaped flanges whose purpose is to engage matching flanges on header 10 and vertical channel 36, to provide the appearance and performance of an uninterrupted single assembly to divert water as will be described hereinafter.

Figure 7:
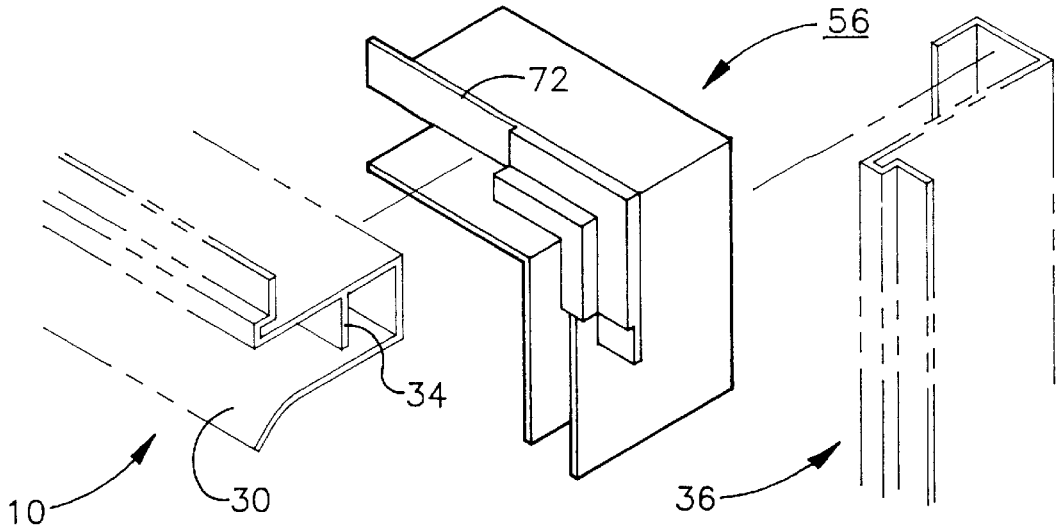
FIG. 7 is an exploded view showing the assembly of the header, right hand corner and right hand vertical channel sections of the flashing system of the present invention.
Figure 8:
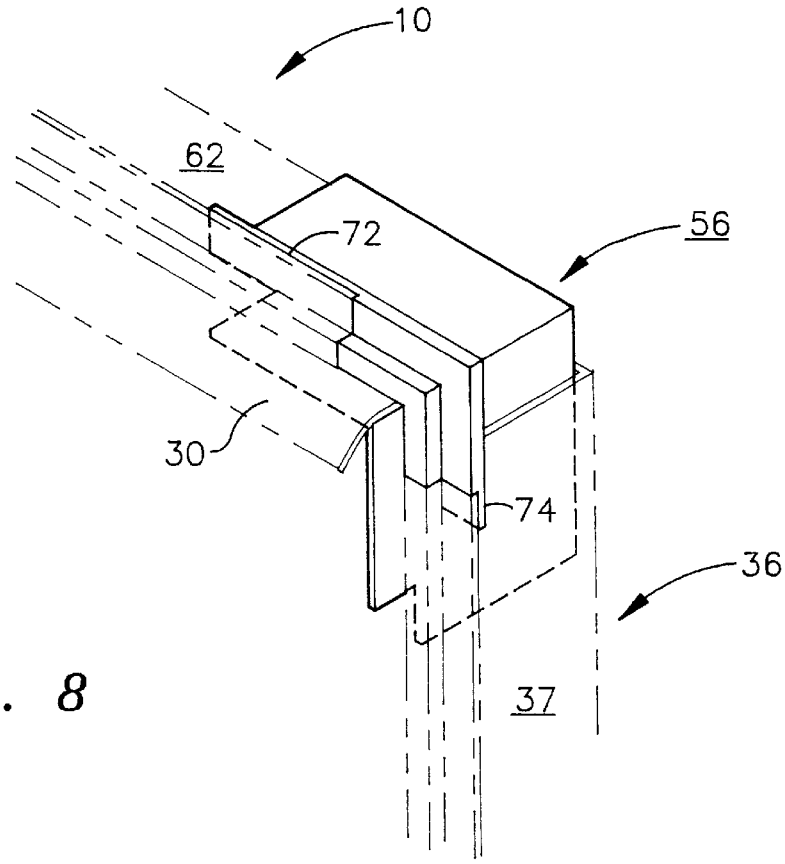
FIG. 8 shows the header, right hand corner and right hand vertical channel sections of the flashing system of the present invention in their assembled configuration.

Inverted, L-shaped forward flange 68 extends from outer front edge 66 in a manner to abut first flange 16 and the base leg 22 of L-shaped flange 20 of header 10 and with third flange 46 of vertical channel 36 at the outer front edge 66 of corner section 56 when the flashing system is assembled as shown in FIGS. 7 and 8 and described hereinafter.

Preferably, inverted L-shaped flange 70, which abuts and lies just behind flange 68, includes flange extension 72. Flange extension 72 defines a recess 76 into which upper leg 24 of L-shaped flange 20 fits upon assembly as described hereinafter. Flange extension 74, which is similar in design and function as flange extension 72, is an extension of flange 70 beyond the termination point of flange 68 and is designed to abut and support upper leg 54 of L-shaped flange 50 of vertical channel 36 upon assembly is also preferably incorporated. Both legs 76 and 78 of forward flange 68 and legs 80 and 82 of rear flange 70 preferably extend only about one third of the length of respective surfaces 62 and 64, however, the exact length thereof is a matter of design choice, so long as proper engagement with the other members of the system is achieved. The same is also true for the lengths and dimensions of flange extensions 72 and 74.

Although the left hand corner section and the left hand vertical channel are not depicted in the accompanying drawings, it will be clear to the skilled artisan that these portions of the flashing system of the present invention are merely mirror images of the right hand corner section and vertical channel depicted in the drawings, and that their assembly is identical, but inverted from that of those shown and described herein.

In practical application, assembly of the flashing system of the present invention is accomplished as follows;

- the width of the door or window to be flashed is measured and an appropriate length of header is cut;
- a portion of dam 26 is peeled back along score 27 and cut off to permit base leg 15 to be inserted into channel 58 of corner section 56;
- the modified header is then inserted into corner section channel 58 such that first flange 16 and L-shaped flange 20 abut flanges 76 and 80 and pushed home to insure a close and tight friction fit;
- an appropriate length of vertical channel 36 is then cut to run down the side of the window or door being flashed;
- corner section 56 is then inserted into vertical channel 36 such that second flange 46 and L-shaped flange 50 abut flanges 78 and 82 respectively and pushed home to insure a tight friction fit;
- the same operations are repeated to assemble the left hand corner section and vertical channel;
- the flashing assembly is then inserted into a previously cut opening about the top and sides of the window or door being flashed;
- backer-rod is then inserted into channel 32 in header 10 and along the front of both vertical channels to prevent the entry of rainwater; and
- any gap between the overlying siding, which abuts surfaces 13, 62, 64, and 37, and flanges 20, 50 and 72 and inner channel 70 is caulked.

When assembled in the fashion just described, and as apparent from FIG. 8, any rainwater which may penetrate behind L-shaped header flange 20, because of inadequate caulking or otherwise, is trapped by dam 26 and drains through weep holes 28 into channel 18 in header 10. From this point, because header 10 is mounted inside of corner section 56 the water is guided through channel 68 within corner section 56 and into channel 38 in vertical section 36. Since vertical section 36 is mounted exteriorly of corner section 56 there is no path by which the water can enter behind the flashing system described herein. Once in channel 38, the water is channeled to the bottom of the window or door and harmlessly removed.

Although the exact dimensions of the various parts of the flashing system described herein are not considered critical to the design and many will be readily determinable to the skilled artisan depending upon the particular installation for which the system is being designed, there are certain preferred configurations for installation where the system is being used in conjunction with the previously described expanded foam siding.

Accordingly, the following is a listing of the preferred dimensions of some of the elements of the system: dam 26 is preferably 3/16 inch high; weep holes 28 are preferably spaced at about two inch intervals; leg 24 is preferably ½ inch high; drip flange 30 is preferably at least ½ inch deep; and leg 54 of L-shaped flange 50 is about ½ inch wide. All of the other dimensions will be related to the thickness of the siding with which the flashing system is being utilized or the particular gauge or thickness of other elements of the system, none of which is considered critical so long as a sufficiently rigid system results.

The material of construction of the flashing system is not particularly critical, but rigid vinyl is preferred. So long as the various elements of the system can be readily and economically fabricated therefrom, any suitable material may be used in the fabrication.

It is intended that the description of the preferred embodiment of the invention presented herein and the accompanying drawings are intended to be illustrative only, and that other embodiments of the invention are within the scope of this invention which is intended to be limited only by the scope of the appended claims.

What is claimed is:

1. A flashing system comprising;

a generally U-shaped header, generally U-shaped right and left hand vertical channels which are mirror images of each other, and right and left hand corner sections which are mirror images of each other;

the header comprises an upper leg having an outer surface, an inner surface and longitudinal front and rear edges, a lower leg having a longitudinal front edge and a base connecting the upper and lower legs to define its general U-shape; a first flange extending vertically and longitudinally from the front edge and having a front surface; an L-shaped flange having a lower leg which extends generally parallel to and in the direction of the outer surface and an upper leg extending generally parallel to the first flange; a dam extending vertically and longitudinally from the rear edge generally parallel to the base and the first flange; weep holes just forward of the dam penetrating the outer surface; a drip flange extending downward from the lower leg front edge; and a second flange extending downward from the upper leg inner surface a portion of the way toward the lower leg and parallel to the base;

each of the vertical channels comprises a short leg, a long leg having a longitudinal front edge, and a base leg joining the long and short legs to define its general U-shape; a third flange extending outwardly, longitudinally and at a generally right angle from the long leg longitudinal front edge and having a front surface; a second generally L-shaped flange having a base leg and an upper leg extending from the third flange such that the base leg extends parallel to and in the direction of the long leg and the upper leg extends outwardly parallel to the vertical channel base;

each of the corner sections comprises a right angled generally U-shaped channel having an open end and a horizontal leg and a vertical leg, an outer surface on the horizontal leg and an outer surface on the vertical leg and an outer front edge extending the length of both outer surfaces at the open end of the U-shaped channel, a pair of L-shaped flanges, one in front of the other to define a front and a rear L-shaped flange, both extending outwardly from the open end of the channel at a generally right angle from both outer surfaces at the outer front edge, both L-shaped flanges being of a size and shape which matches those of the L-shaped flanges on the header and the vertical channels;

the individual elements being sized such that the header can be inserted into the horizontal leg of the corner sections and the corner sections can be inserted into the vertical channels with appropriate registration of all flanges, and to provide a continuous passage for any water which infiltrates to the outer surface of the upper leg of the header, is trapped by the dam, by passing through the weep holes into the header, through the corner section and into the vertical channels for removal.

2. The flashing system of claim 1 further including in the dam an indentation at or just above the point where it meets the rear edge of the upper outer surface permit ease of removing portions thereof.

3. The flashing system of claim 1 wherein the front surfaces of the first flange and the third flange have longitudinal ridges.

4. The flashing system of claim 1 wherein the rear L-shaped flange of the corner section has a horizontal leg and a vertical leg and includes flange extensions at each end of its horizontal and vertical legs which serve to support the upper legs of the L-shaped flanges of both the header and the vertical channel upon assembly.

5. An elongated generally U-shaped header for use in a flashing system comprising:

An upper leg having an outer surface, an inner surface and longitudinal front and rear edges;

A lower leg having a longitudinal front side;

A base connecting said upper and said lower legs to define a general U-shape;

a first flange extending vertically and longitudinally from said front edge and having a front surface;

An L-shaped flange having a lower leg which extends generally parallel to and in the direction of said outer surface and an upper leg extending generally parallel to said first flange;

Weep holes just forward of the dam penetrating said outer surface;

A drip flange extending downward from said lower leg front side;

A second flange extending downward from said upper leg inner surface a portion of the way toward said lower leg and parallel to said base.

* * * * *